United States Patent [19]

Lee et al.

[11] 4,047,708

[45] Sept. 13, 1977

[54] DETACHABLE LIP RING FOR STEELMAKING CONVERTER

[75] Inventors: Edward J. Lee, Hobart; Frank Vavra, Ross, both of Ind.

[73] Assignee: United States Steel Corporation, Pittsburgh, Pa.

[21] Appl. No.: 729,568

[22] Filed: Oct. 4, 1976

[51] Int. Cl.[2] ..... C21C 5/46

[52] U.S. Cl. ..... 266/243

[58] Field of Search ..... 266/137, 158, 200, 218, 266/220–226, 241, 243–247, 280, 281, 283, 287; 75/60

[56] References Cited

U.S. PATENT DOCUMENTS

| | | | |
|---|---|---|---|
| 795,092 | 7/1905 | Baggaley et al. | 266/241 |
| 832,665 | 10/1906 | Haas | 266/218 |
| 903,163 | 11/1908 | Bleyer | 266/245 |
| 1,205,611 | 11/1916 | Ford | 266/225 |
| 2,733,141 | 1/1956 | Sims | 266/245 |
| 3,201,108 | 8/1965 | Kramer | 266/246 |
| 3,687,436 | 8/1972 | Wortman | 266/241 |

*Primary Examiner*—Gerald A. Dost
*Attorney, Agent, or Firm*—John F. Carney

[57] ABSTRACT

The lip ring on an oxygen steelmaking converter is detachably connected to the top cone of the converter to permit the lip ring to be removed from the top cone when the former becomes damaged, as during deskulling operations. The connection between the lip ring and the top cone is made by swing bolts that are pivotally mounted to the top cone and the flange interface that effects the connection between the lip ring and the top cone is conically formed to eliminate the development of shear stresses in the bolts such that smaller and fewer bolts can be employed to reduce the costs attendant with, and the time required for, replacement of the lip ring.

6 Claims, 4 Drawing Figures

DETACHABLE LIP RING FOR STEELMAKING CONVERTER

BACKGROUND OF THE INVENTION

In the oxygen production of steel, typically by the basic oxygen process, scrap metal and molten iron are charged into a generally cylindrical refractory-line converter at the upper end of which is provided a mouth opening surrounded by an annular lip ring. The charge is subject to a high velocity blow of relatively pure oxygen that is delivered to the charge through an oxygen lance that extends into the converter through the mouth opening. The oxygen blow, besides refining the converter charge, also produces a considerable amount of turbulance therein causing considerable splattering. As a result of this splattering, molten metal and other debris, commonly referred to as skull, are deposited on the converter lip ring. Since skull forms an obstruction that gradually closes the mouth opening, continued operation of the converter requires that skull be removed when it reaches an objectionable level.

The deskulling operation is conventionally conducted in one of the following ways: by repeated oscillation of the converter past a plurality of steel billets that protrude into the path of the skull thereby raking the same from the surface of the lip ring; by dislodging the skull by means of hydraulic or pneumatic jack hammers; or by battering the lip ring with a deskulling ram that is normally suspended from and operated by an overhead crane. Each of these methods of removing skull will, after repeated applications, ultimately result in damage to the converter, typically to the lip ring or to the converter shell adjacent thereto. Alternatively however, the damage may be to the refractory lining that underlies the upper region of the converter top cone. In either event, the affected portion of the unit must be replaced. In the past, when the lip ring was directly attached to the top cone of the converter, it was necessary to replace the entire top cone even though damage was limited to that region of the top cone underlying the lip ring. Such replacement of the entire top cone is undesirable for several reasons. It requires the laborious efforts of a team of workmen, usually upwards of 10, to manipulate pry bars, cables, and a heavy counterweight removal device for an extended period of time. It further presents a safety problem in that the working apparatus, such as torch hoses, welding leads and cables offer a definite tripping hazard to the workmen. Moreover, because an overhead crane is required to remove the spent top cone from the converter and to install the new one thereon, its availability in connection with the operation of other converters in the immediate vicinity is adversely affected, thereby tending to retard and maybe even to terminate the operation of these other converters.

It has been suggested to form the lip ring of a steelmaking converter as a member detachable from the top cone portion of the shell. U.S. Pat. No. 3,350,085, issued Oct. 31, 1967 to R. E. Over, discloses apparatus of this type. However, structures such as those described in this patent are not totally dispositive of the problem in view of the fact that the connection between the lip ring and the converter top cone is made through flanges that are disposed parallel to the direction of the shear forces to which the unit will be subject when deskulling of the lip ring is conducted. Therefore, in order to accommodate these shear forces, a great number of large diameter bolts or studs are required to secure the lip ring to the top cone. The use of such large bolts or studs in connecting these members is costly both from the standpoint of equipment requirements and also in the amount of time necessary to remove a spent lip ring and install a new one when replacement of the lip ring is required.

It is to the solution of such problems, therefore, that the present invention is directed.

SUMMARY OF THE INVENTION

According to the present invention, there is provided in a converter for the pneumatic refining of metals including a generally cylindrical shell having a mouth opening at the upper end thereof and an annular lip ring assembly surrounding said opening, means for detachably connecting said lip ring assembly to the remainder of said shell including means forming conically disposed facing surfaces on said lip ring assembly and the adjacent end of the remainder of said shell and detachable connector means for connecting said parts and placing said conical surfaces in tight contiguous relation.

In oxygen steelmaking converters constructed according to the present invention, the replacement of the lip ring is greatly facilitated. The ease with which such replacement can occur results in a reduction both in the down time of the converter necessary to effect the replacement of the lip ring as well as in the cost of the equipment necessary to make the connection between the lip ring and the remainder of the converter shell.

For a better understanding of the invention, its operating advantages and the specific objectives obtained by its use, reference should be made to the accompanying drawings and description which relate to a preferred embodiment thereof.

PREFERRED EMBODIMENT OF THE INVENTION

Figure 2:
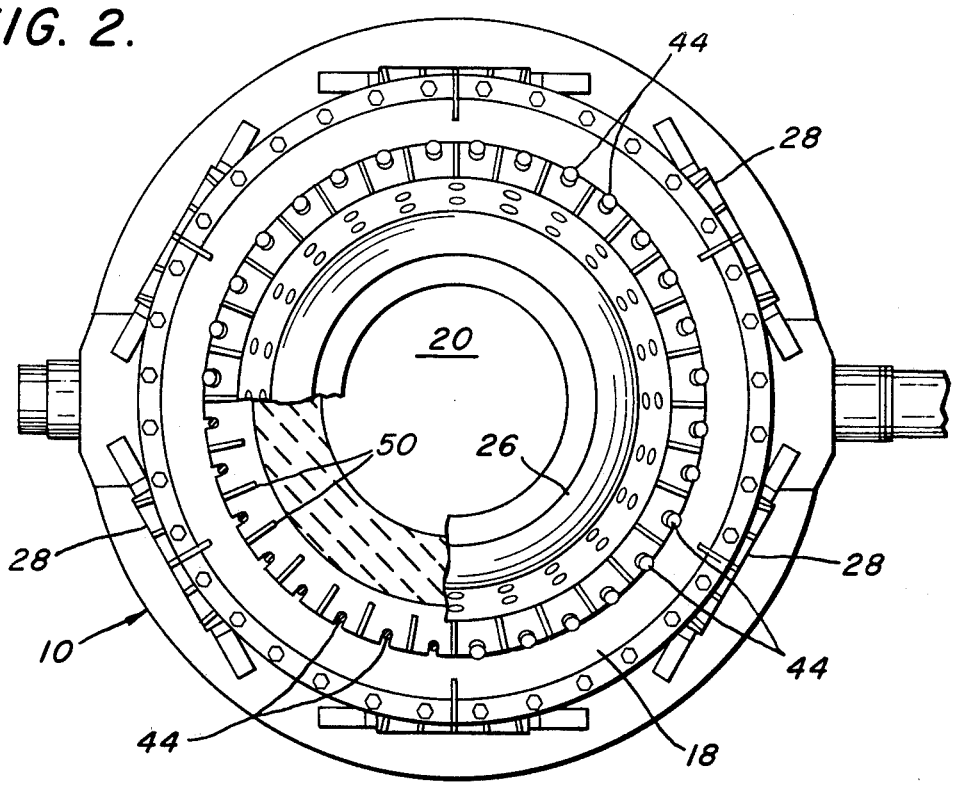
FIG. 2 is a top view of the converter of FIG. 1.
Figure 1:
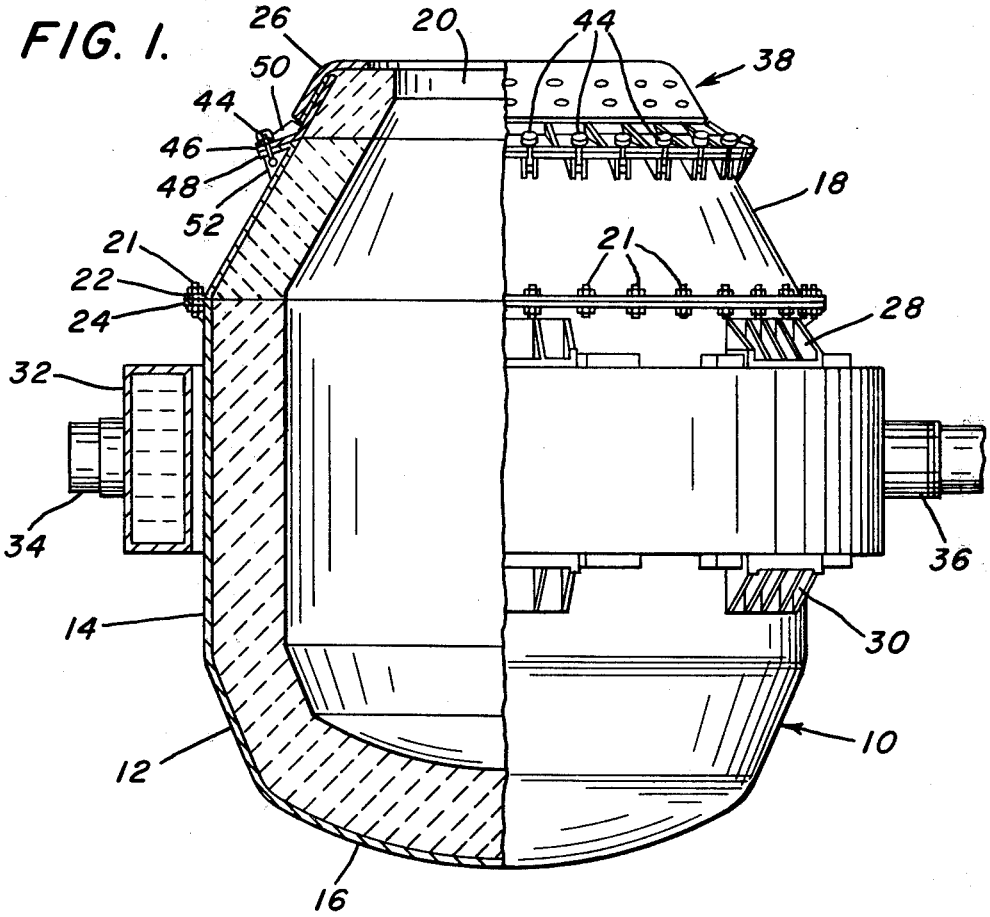
FIG. 1 is an elevational view, partly in section, of an oxygen steelmaking converter constructed according to the invention.

In FIG. 1 of the drawing, there is shown a converter 10 comprising a refractory-lined metallic shell 12 having a generally cylindrical wall portion 14 with an integrally formed bottom 16. The upper part of the shell is defined by a top cone 18 that is formed as a conical frustrum having an axially disposed annular opening 20 at its upper end. The top cone 18 is attached to the wall portion 14 of the shell by means of circumferentially spaced connectors 21 that extend through horizontally disposed mating flanges 22 and 24 on the top cone and the wall portion respectively. An annular lip ring 26 surrounds the opening 20 at the upper end of the shell. The converter 10 is mounted by means of top and bottom support brackets 28 and 30, respectively, in a fluid cooled trunnion ring 32 having oppositely extending trunnion pins 34 and 36 to accommodate pivotal movement of the converter on pedestals (not shown), all as is well known in the art.

Figure 3:
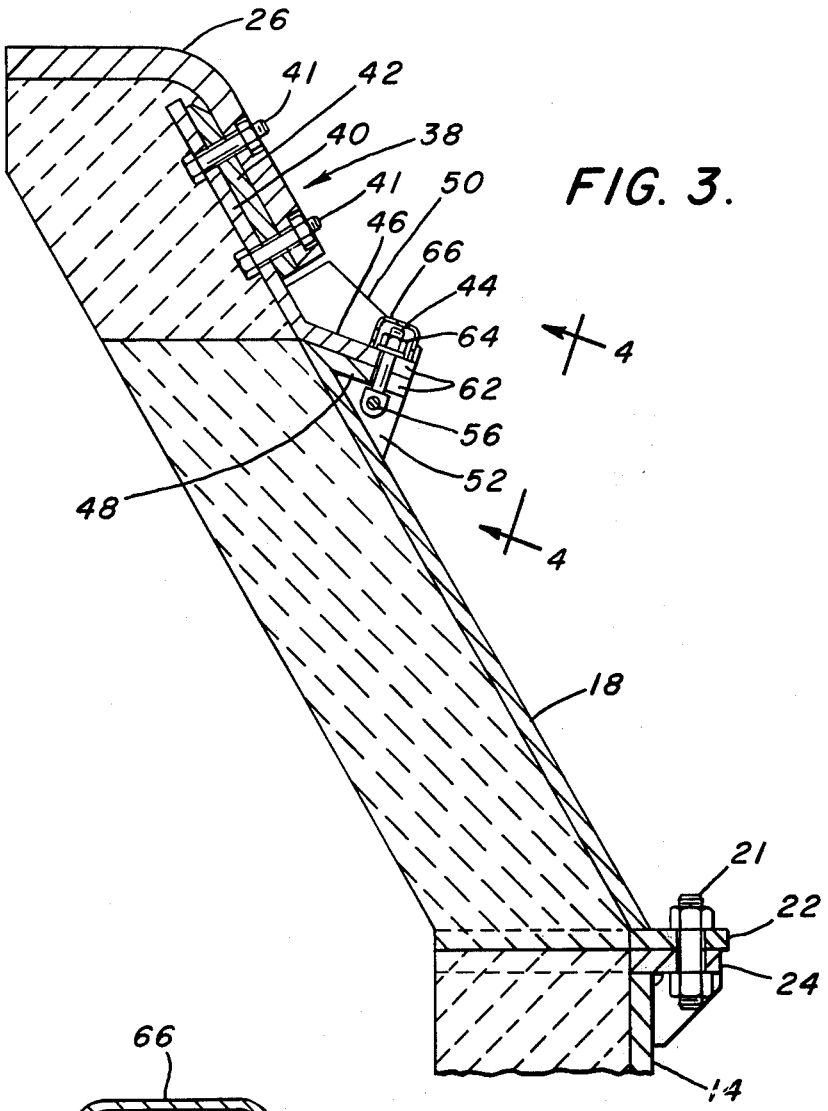
FIG. 3 is an enlarged elevational section of the upper portion of the converter of FIG. 1.

According to the present invention, the lip ring 26 forms part of a lip ring assembly, indicated generally as 38, which is detachably connected to the adjacent end of the top cone 18. The lip ring assembly includes a lip ring mount 40 formed by a conically shaped metallic plate having substantially the same taper as the top cone 18. The lip ring 26 is fastened to the mount 40 by means of threaded bolts 41 extending through the lip ring and the mount. As shown in FIG. 3, a spacer cone 42 may be interposed between the lip ring and the mount to render the total structure more rigid.

Attachment of the lip ring assembly 38 to the top cone 18 is effected by means of a plurality of circumferentially spaced swing bolts 44 which are operatively positioned to extend through cooperating flanges 46 and 48 that extend outwardly from the adjacent ends of the lip ring mount 40 and of the top cone 18 as hereinafter more fully described. These flanges 46 and 48 are, themselves, formed as conical members but extend downwardly from the external surface of the lip ring assembly 38 and top cone 18 by about twenty degrees from the horizontal such that that flange 46 attached to the lower end of the lip ring mount 40 presents a concave face in mating engagement with a convex face on the flange 48 attached to the upper end of the top cone 18.

Figure 4:
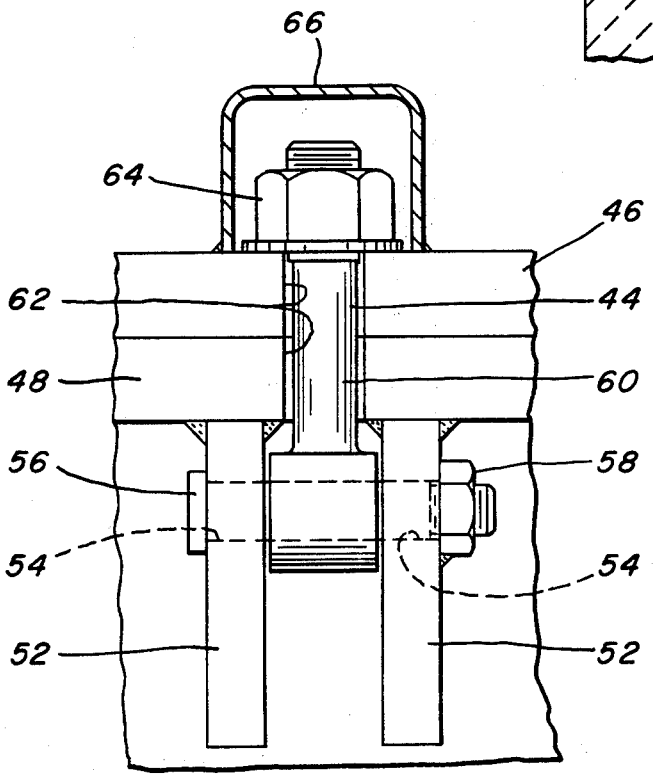
FIG. 4 is an enlarged elevational view taken along line 4—4 of FIG. 3.

Gussets 50 at circumferentially spaced locations about the flange 46 and weldedly connected to the flange and to the external of the mount 40 serve to stiffen the flange while gussets 52 that underlie the flange 48 and are welded thereto and to the external surface of the top cone perform a similar function with respect to that flange. However, as best shown in FIG. 4, the gussets 52 are arranged in pairs that are spaced about the circumference of the flange and are provided each with aligned openings 54 to accommodate headed bolts 56 that are secured to the gussets by threaded nuts 58 and thereby form pivot pins to mount the swing bolts 44.

The swing bolts 44 are pivotally mounted between the respective pairs of gussets 52 and are adapted to have their shafts 60 extend through aligned slots 62 that are circumferentially spaced about the edges of the respective flanges 46 and 48. Nuts 64 are adapted to threadedly engage the swing bolt shafts 60 and thereby secure the mating flanges together. A protective cover 66 encloses each of the nuts 64 and has its lower edge weldedly connected to the upper surface of the flange 46 to prevent the mating threads from being damaged during the metal refining process.

When it is desired to replace the lip ring 26, the weldment between the covers 66 and the flange 46 are broken to expose the nuts 64. The nuts are disconnected from the swing bolts 44 whereby the lip ring assembly can be simply lifted from its mounted position on the top cone 18. The installation of a new lip ring assembly is effected by reversing the procedure.

It will be appreciated that, due to the annular relationship of the flanges 46 and 48 with respect to the top cone 18 and the lip ring mount 40 and, more particularly, to the interengagement that exists between the mating faces on these flanges, any lateral forces imposed upon the ring lip 26, as for example during deskulling, will not be transferred to the swing bolts 44 as shear forces but, instead, will be offset by the abutment presented by the angularly offset flanges. In this way, the bolts need be designed only to accommodate the tensile stresses imposed thereon in joining the mating flanges together. Thus, not only will smaller swing bolts be required to effectively secure the lip ring to the top cone but the bolts will be reduced in number thereby reducing the time required to replace the lip ring, and concomitently, the downtime of the coverter from productive operation.

It will be understood that various changes in the details, materials and arrangements of parts which have been herein described and illustrated in order to explain the nature of the invention, may be made by those skilled in the art within the principle and scope of the invention as expressed in the appended claims.

We claim:

1. In a converter for the pneumatic refining of metals including a generally cylindrical refractory-lined shell having an annular opening at one end of the shell axis and entending transversely thereof and an annular refractory-lined lip ring assembly detachably mounted on said shell in surrounding relation to said opening and wherein the interface between said shell lining and said lip ring lining is substantially normal to said shell axis, the improvement comprising means for mounting said lip ring assembly upon said shell including:

a. a first annular flange fixedly attached to the exterior surface of said shell about said annular opening and being formed as a conical frustrum defining an angle with respect to the interface between said shell and lip ring linings;

b. a second annular flange fixedly attached to the exterior surface of said lip ring assembly adjacent the bottom thereof, said second flange being formed as a conical frustrum and having a bearing surface for engaging said first annular flange in mating facing relation; and c. a plurality of circumferentially spaced, detachable bolts penetrating said flanges in angularly disposed relation to said shell and lip ring interface and operative to place said mating flange surfaces in tight contiguous relation.

2. The improvement of claim 1 in which said flanges include a plurality of circumferentially spaced slots and said connector means include a plurality of swing bolts pivotally attached to one of the respective parts being connected and operative to be received in the respective of said slots.

3. The improvement as recited in claim 2 in which said swing bolts are pivotally attached to the remainder of said shell and further including a nut threadedly received on each of said bolts and a nut protector cap enclosing said nut.

4. The improvement as recited in claim 2 including a plurality of circumferentially spaced gussets extending between said shell and the flange associated therewith, said gussets being disposed in pairs, a pivot pin mounted between each of said pairs of gussets, and means for attaching said swing bolts to the respective pivot pins.

5. The improvement as recited in claim 1 in which said conical surfaces are disposed at an angle of about 20° with respect to the horizontal.

6. The improvement of claim 1 in which said first annular flange defines an acute angle with respect to the adjacent shell surface.

* * * * *